US009569921B2

(12) United States Patent
LeMay et al.

(10) Patent No.: US 9,569,921 B2
(45) **Date of Patent: *Feb. 14, 2017**

(54) PLAYER DRIVEN GAME DOWNLOAD TO A GAMING MACHINE

(71) Applicant: IGT, Las Vegas, NV (US)

(72) Inventors: Steven G. LeMay, Reno, NV (US); Dwayne A. Davis, Reno, NV (US); Dwayne R. Nelson, Las Vegas, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/843,629

(22) Filed: Sep. 2, 2015

(65) Prior Publication Data

US 2015/0379813 A1 Dec. 31, 2015

Related U.S. Application Data

(63) Continuation of application No. 13/609,505, filed on Sep. 11, 2012, now Pat. No. 9,129,469.

(51) Int. Cl.

| | |
|---|---|
| ***G07F 17/32*** | (2006.01) |
| ***A63F 9/24*** | (2006.01) |
| ***G07F 17/34*** | (2006.01) |

(52) U.S. Cl.

CPC ..... *G07F 17/3227* (2013.01); *A63F 9/24* (2013.01); *G07F 17/323* (2013.01); *G07F 17/3204* (2013.01); *G07F 17/3255* (2013.01); *G07F 17/3293* (2013.01); *G07F 17/34* (2013.01)

(58) Field of Classification Search

CPC ..... G07F 17/32

See application file for complete search history.

(56) References Cited

U.S. PATENT DOCUMENTS

| | | | |
|---|---|---|---|
| 3,708,219 | A | 1/1973 | Forlini et al. |
| 3,931,504 | A | 1/1976 | Jacoby |
| 4,333,715 | A | 6/1982 | Brooks |
| 4,430,728 | A | 2/1984 | Beitel et al. |
| 4,454,594 | A | 6/1984 | Heffron et al. |
| 4,517,558 | A | 5/1985 | Davids |
| 4,607,844 | A | 8/1986 | Fullerton |
| 4,621,814 | A | 11/1986 | Stepan et al. |
| 4,659,182 | A | 4/1987 | Aizawa |
| 4,718,672 | A | 1/1988 | Okada |
| 4,856,787 | A | 8/1989 | Itkis |
| 4,911,449 | A | 3/1990 | Dickinson et al. |

(Continued)

FOREIGN PATENT DOCUMENTS

| | | |
|---|---|---|
| AU | 199650576 | 4/1997 |
| AU | 775882 | 8/2004 |

(Continued)

OTHER PUBLICATIONS

"IGT Service Window," IGT Network Systems, 2010, 2 pages.

(Continued)

*Primary Examiner* — Omkar Deodhar

(74) *Attorney, Agent, or Firm* — Neal, Gerber & Eisenberg LLP

(57) ABSTRACT

A service window may be provided to a gaming machine, such as a video slot machine, video poker machine, or similar electronic device. The service window may include an option to request an available game for download. A request for the game may be received via the service window and the game may be provided to the gaming machine.

22 Claims, 6 Drawing Sheets

(56) References Cited

U.S. PATENT DOCUMENTS 4,912,548 A 3/1990 Shanker et al.
5,086,354 A 2/1992 Bass et al.
5,113,272 A 5/1992 Reamey
5,132,839 A 7/1992 Travis
5,319,491 A 6/1994 Selbrede
5,342,047 A 8/1994 Heidel et al.
5,364,100 A 11/1994 Ludlow et al.
5,375,830 A 12/1994 Takemoto et al.
5,376,587 A 12/1994 Buchmann et al.
5,393,061 A 2/1995 Manship et al.
5,467,893 A 11/1995 Landis, II et al.
5,539,547 A 7/1996 Ishii et al.
5,580,055 A 12/1996 Hagiwara
5,585,821 A 12/1996 Ishikura et al.
5,589,980 A 12/1996 Bass et al.
5,643,086 A 7/1997 Alcorn et al.
5,655,961 A 8/1997 Acres et al.
5,745,197 A 4/1998 Leung et al.
5,752,881 A 5/1998 Inoue
5,761,647 A 6/1998 Boushy
5,764,317 A 6/1998 Sadovnik et al.
5,820,459 A 10/1998 Acres et al.
5,836,817 A 11/1998 Acres et al.
5,851,149 A 12/1998 Xidos et al.
5,910,046 A 6/1999 Wada et al.
5,923,307 A 7/1999 Hogle, IV
5,951,397 A 9/1999 Dickinson
5,956,180 A 9/1999 Bass et al.
5,967,893 A 10/1999 Lawrence et al.
6,001,016 A 12/1999 Walker et al.
6,015,346 A 1/2000 Bennett
6,027,115 A 2/2000 Griswold et al.
6,050,895 A 4/2000 Luciano et al.
6,054,969 A 4/2000 Haisma
6,059,658 A 5/2000 Mangano et al.
6,068,552 A 5/2000 Walker et al.
6,099,408 A 8/2000 Schneier et al.
6,104,815 A 8/2000 Alcorn et al.
6,106,396 A 8/2000 Alcorn et al.
6,110,041 A 8/2000 Walker et al.
6,113,495 A 9/2000 Walker et al.
6,135,884 A 10/2000 Hedrick et al.
6,149,522 A 11/2000 Alcorn et al.
6,159,098 A 12/2000 Slomiany et al.
6,190,256 B1 2/2001 Walker et al.
6,213,875 B1 4/2001 Suzuki
6,244,596 B1 6/2001 Kondratjuk
6,244,958 B1 6/2001 Acres
6,251,014 B1 6/2001 Stockdale et al.
6,252,707 B1 6/2001 Kleinberger et al.
6,253,374 B1 6/2001 Dresevic et al.
6,254,481 B1 7/2001 Jaffe
6,254,483 B1 7/2001 Acres
6,293,866 B1 9/2001 Walker et al.
6,315,666 B1 11/2001 Mastera et al.
6,319,125 B1 11/2001 Acres
6,337,513 B1 1/2002 Clevenger et al.
6,347,996 B1 2/2002 Gilmore et al.
6,361,437 B1 3/2002 Walker et al.
6,368,216 B1 4/2002 Hedrick et al.
6,379,244 B1 4/2002 Sagawa et al.
6,398,220 B1 6/2002 Inoue
6,398,645 B1 6/2002 Yoseloff
6,416,827 B1 7/2002 Chakrapani et al.
6,444,496 B1 9/2002 Edwards et al.
6,445,185 B1 9/2002 Damadian et al.
6,446,257 B1 9/2002 Pradhan et al.
6,449,687 B1 9/2002 Moriya
6,453,319 B1 9/2002 Mattis et al.
6,454,648 B1 9/2002 Kelly et al.
6,491,583 B1 12/2002 Gauselmann
6,503,147 B1 1/2003 Stockdale et al.
6,511,375 B1 1/2003 Kaminkow
6,512,559 B1 1/2003 Hashimoto et al.
6,514,141 B1 2/2003 Kaminkow et al.
6,517,433 B2 2/2003 Loose et al.
6,517,437 B1 2/2003 Wells et al.
6,547,664 B2 4/2003 Saunders
6,575,541 B1 6/2003 Hedrick et al.
6,585,591 B1 7/2003 Baerlocher et al.
6,620,047 B1 9/2003 Alcorn et al.
D480,961 S 10/2003 Deadman
6,645,077 B2 11/2003 Rowe
6,646,695 B1 11/2003 Gauselmann
6,648,758 B2 11/2003 Bennett et al.
6,652,378 B2 11/2003 Cannon et al.
6,656,040 B1 12/2003 Brosnan et al.
6,659,864 B2 12/2003 McGahn et al.
6,661,425 B1 12/2003 Hiroaki
6,695,703 B1 2/2004 McGahn
6,702,675 B2 3/2004 Poole et al.
6,712,694 B1 3/2004 Nordman
6,715,756 B2 4/2004 Inoue
6,717,728 B2 4/2004 Putilin
6,722,979 B2 4/2004 Gilmore et al.
6,802,777 B2 10/2004 Seelig et al.
6,811,486 B1 11/2004 Luciano, Jr.
6,817,945 B2 11/2004 Seelig et al.
6,817,946 B2 11/2004 Motegi et al.
6,887,157 B2 5/2005 LeMay et al.
6,890,259 B2 5/2005 Breckner et al.
6,906,762 B1 6/2005 Witehira et al.
6,937,298 B2 8/2005 Okada
6,939,226 B1 9/2005 Joshi
6,960,136 B2 11/2005 Joshi et al.
6,969,319 B2 11/2005 Rowe et al.
7,022,017 B1 4/2006 Halbritter et al.
7,095,180 B2 8/2006 Emslie et al.
7,097,560 B2 8/2006 Okada
7,128,647 B2 10/2006 Muir et al.
7,159,865 B2 1/2007 Okada
7,160,187 B2 1/2007 Loose et al.
7,204,753 B2 4/2007 Ozaki et al.
7,207,883 B2 4/2007 Nozaki et al.
7,220,181 B2 5/2007 Okada
7,252,288 B2 8/2007 Seelig et al.
7,255,643 B2 8/2007 Ozaki et al.
7,309,284 B2 12/2007 Griswold et al.
7,322,884 B2 1/2008 Emori et al.
7,329,181 B2 2/2008 Hoshino et al.
7,618,319 B2 11/2009 Casey et al.
7,619,585 B2 11/2009 Bell et al.
7,722,466 B2 5/2010 Rothschild
7,730,413 B1 6/2010 Engel et al.
7,918,734 B2 4/2011 Gould
8,029,351 B2 10/2011 Kosaka et al.
8,029,360 B2 10/2011 Lind et al.
8,131,649 B2 3/2012 Yen et al.
2001/0013681 A1 8/2001 Bruzzese et al.
2002/0045472 A1 4/2002 Adams
2002/0142825 A1 10/2002 Lark et al.
2002/0142846 A1 10/2002 Paulsen
2002/0173354 A1 11/2002 Winans et al.
2002/0183105 A1 12/2002 Cannon et al.
2002/0194505 A1 12/2002 Muschenborn
2003/0027624 A1 2/2003 Gilmore et al.
2003/0032478 A1 2/2003 Takahama et al.
2003/0032479 A1 2/2003 LeMay et al.
2003/0060268 A1 3/2003 Falconer
2003/0064771 A1 4/2003 Morrow et al.
2003/0064801 A1 4/2003 Breckner
2003/0069074 A1 4/2003 Jackson
2003/0083943 A1 5/2003 Adams et al.
2003/0087690 A1 5/2003 Loose et al.
2003/0130028 A1 7/2003 Aida et al.
2003/0162582 A1 8/2003 Gordon
2003/0176214 A1 9/2003 Burak et al.
2003/0222876 A1 12/2003 Giemborek et al.
2003/0236114 A1 12/2003 Griswold et al.
2004/0002377 A1 1/2004 Staw et al.
2004/0009813 A1 1/2004 Wind
2004/0023714 A1 2/2004 Asdale
2004/0029636 A1 2/2004 Wells
2004/0048671 A1 3/2004 Rowe

(56) References Cited

U.S. PATENT DOCUMENTS

| | | | |
|---|---|---|---|
| 2004/0063490 | A1 | 4/2004 | Okada |
| 2004/0066475 | A1 | 4/2004 | Searle |
| 2004/0087360 | A1 | 5/2004 | Chamberlain et al. |
| 2004/0103444 | A1 | 5/2004 | Weinberg et al. |
| 2004/0110557 | A1 | 6/2004 | Rowe |
| 2004/0116178 | A1 | 6/2004 | Okada |
| 2004/0117484 | A1 | 6/2004 | Singer et al. |
| 2004/0127284 | A1 | 7/2004 | Walker et al. |
| 2004/0147303 | A1 | 7/2004 | Imura et al. |
| 2004/0147322 | A1 | 7/2004 | Okada |
| 2004/0150162 | A1 | 8/2004 | Okada |
| 2004/0152509 | A1 | 8/2004 | Hornik et al. |
| 2004/0162146 | A1 | 8/2004 | Ooto |
| 2004/0166925 | A1 | 8/2004 | Emori et al. |
| 2004/0171423 | A1 | 9/2004 | Silva et al. |
| 2004/0180712 | A1 | 9/2004 | Forman et al. |
| 2004/0180721 | A1 | 9/2004 | Rowe |
| 2004/0183972 | A1 | 9/2004 | Bell |
| 2004/0192430 | A1 | 9/2004 | Burak et al. |
| 2004/0198485 | A1 | 10/2004 | Loose |
| 2004/0207154 | A1 | 10/2004 | Okada |
| 2004/0208126 | A1 | 10/2004 | Wassew et al. |
| 2004/0209666 | A1 | 10/2004 | Okada et al. |
| 2004/0209667 | A1 | 10/2004 | Emori et al. |
| 2004/0209668 | A1 | 10/2004 | Okada |
| 2004/0209671 | A1 | 10/2004 | Okada |
| 2004/0209678 | A1 | 10/2004 | Okada |
| 2004/0209683 | A1 | 10/2004 | Okada |
| 2004/0214635 | A1 | 10/2004 | Okada |
| 2004/0214637 | A1 | 10/2004 | Nonaka |
| 2004/0219968 | A1 | 11/2004 | Fiden |
| 2004/0224747 | A1 | 11/2004 | Okada |
| 2004/0233663 | A1 | 11/2004 | Emslie et al. |
| 2004/0239582 | A1 | 12/2004 | Seymour |
| 2004/0254010 | A1 | 12/2004 | Fine |
| 2005/0020348 | A1 | 1/2005 | Thomas et al. |
| 2005/0020358 | A1 | 1/2005 | Cram |
| 2005/0032571 | A1 | 2/2005 | Asonuma |
| 2005/0037843 | A1 | 2/2005 | Wells et al. |
| 2005/0043086 | A1 | 2/2005 | Schneider |
| 2005/0049032 | A1 | 3/2005 | Kobayashi |
| 2005/0049046 | A1 | 3/2005 | Kobayashi |
| 2005/0059494 | A1 | 3/2005 | Kammler |
| 2005/0062410 | A1 | 3/2005 | Bell et al. |
| 2005/0063055 | A1 | 3/2005 | Engel |
| 2005/0079913 | A1 | 4/2005 | Inamura |
| 2005/0085292 | A1 | 4/2005 | Inamura |
| 2005/0119052 | A1 | 6/2005 | Russell et al. |
| 2005/0153772 | A1 | 7/2005 | Griswold et al. |
| 2005/0153775 | A1 | 7/2005 | Griswold et al. |
| 2005/0153776 | A1 | 7/2005 | LeMay et al. |
| 2005/0153778 | A1 | 7/2005 | Nelson et al. |
| 2005/0164762 | A1 | 7/2005 | Smith et al. |
| 2005/0192090 | A1 | 9/2005 | Muir et al. |
| 2005/0193269 | A1 | 9/2005 | Haswell et al. |
| 2005/0206582 | A1 | 9/2005 | Bell et al. |
| 2005/0208994 | A1 | 9/2005 | Berman |
| 2005/0215311 | A1 | 9/2005 | Hornik et al. |
| 2005/0233794 | A1 | 10/2005 | Cannon et al. |
| 2005/0233799 | A1 | 10/2005 | LeMay et al. |
| 2005/0239539 | A1 | 10/2005 | Inamura |
| 2005/0266912 | A1 | 12/2005 | Sekiguchi |
| 2005/0282638 | A1 | 12/2005 | Rowe |
| 2005/0285337 | A1 | 12/2005 | Durham et al. |
| 2006/0009273 | A2 | 1/2006 | Moshal |
| 2006/0041586 | A1 | 2/2006 | Nassef, Jr. |
| 2006/0063581 | A1 | 3/2006 | Harris et al. |
| 2006/0068898 | A1 | 3/2006 | Maya |
| 2006/0079333 | A1 | 4/2006 | Morrow et al. |
| 2006/0089194 | A1 | 4/2006 | Joshi et al. |
| 2006/0094508 | A1 | 5/2006 | D'Amico et al. |
| 2006/0100014 | A1 | 5/2006 | Griswold et al. |
| 2006/0103951 | A1 | 5/2006 | Bell et al. |
| 2006/0105837 | A1 | 5/2006 | Walker et al. |
| 2006/0105841 | A1 | 5/2006 | Rom et al. |
| 2006/0125745 | A1 | 6/2006 | Evanicky |
| 2006/0135255 | A1 | 6/2006 | Roth |
| 2006/0143085 | A1 | 6/2006 | Adams et al. |
| 2006/0154729 | A1 | 7/2006 | LeMay et al. |
| 2006/0166727 | A1 | 7/2006 | Burak |
| 2006/0184626 | A1 | 8/2006 | Agapi et al. |
| 2006/0190482 | A1 | 8/2006 | Kishan et al. |
| 2006/0191177 | A1 | 8/2006 | Engel |
| 2006/0217202 | A1 | 9/2006 | Burke et al. |
| 2006/0264256 | A1 | 11/2006 | Gagner et al. |
| 2006/0264257 | A1 | 11/2006 | Jaffe et al. |
| 2006/0282855 | A1 | 12/2006 | Margulis |
| 2006/0284574 | A1 | 12/2006 | Emslie et al. |
| 2006/0290594 | A1 | 12/2006 | Engel et al. |
| 2007/0004510 | A1 | 1/2007 | Underdahl et al. |
| 2007/0004513 | A1 | 1/2007 | Wells et al. |
| 2007/0010315 | A1 | 1/2007 | Hein |
| 2007/0015569 | A1 | 1/2007 | Norton et al. |
| 2007/0024002 | A1 | 2/2007 | McMain et al. |
| 2007/0032288 | A1 | 2/2007 | Nelson et al. |
| 2007/0043616 | A1 | 2/2007 | Kutaragi et al. |
| 2007/0060317 | A1 | 3/2007 | Martin |
| 2007/0066381 | A1 | 3/2007 | Matsuno et al. |
| 2007/0167210 | A1 | 7/2007 | Kelly et al. |
| 2007/0180400 | A1 | 8/2007 | Zotov et al. |
| 2007/0243925 | A1 | 10/2007 | LeMay et al. |
| 2007/0243928 | A1 | 10/2007 | Iddings |
| 2007/0243934 | A1 | 10/2007 | Little et al. |
| 2007/0270211 | A1 | 11/2007 | Moshal |
| 2008/0008188 | A1 | 1/2008 | Buga et al. |
| 2008/0009344 | A1 | 1/2008 | Graham et al. |
| 2008/0020816 | A1 | 1/2008 | Griswold et al. |
| 2008/0020839 | A1 | 1/2008 | Wells et al. |
| 2008/0020840 | A1 | 1/2008 | Wells et al. |
| 2008/0020841 | A1 | 1/2008 | Wells et al. |
| 2008/0076574 | A1 | 3/2008 | Okada |
| 2008/0096655 | A1 | 4/2008 | Rasmussen et al. |
| 2008/0113747 | A1 | 5/2008 | Williams et al. |
| 2008/0125219 | A1 | 5/2008 | Williams et al. |
| 2008/0167113 | A1 | 7/2008 | Plowman |
| 2009/0036190 | A1 | 2/2009 | Brosnan et al. |
| 2009/0098943 | A1 | 4/2009 | Weber et al. |
| 2009/0104954 | A1 | 4/2009 | Weber et al. |
| 2009/0156303 | A1 | 6/2009 | Kiely et al. |
| 2009/0233705 | A1 | 9/2009 | LeMay et al. |
| 2010/0105454 | A1 | 4/2010 | Weber et al. |
| 2011/0003642 | A1 | 1/2011 | Russell et al. |
| 2013/0244762 | A1 | 9/2013 | Walker et al. |

FOREIGN PATENT DOCUMENTS

| | | |
|---|---|---|
| EP | 0454423 | 10/1991 |
| EP | 0484103 | 5/1992 |
| EP | 0655265 | 5/1995 |
| EP | 0769769 | 4/1997 |
| EP | 0997857 | 10/1999 |
| EP | 1195184 | 4/2002 |
| EP | 1255234 | 11/2002 |
| EP | 1260928 | 11/2002 |
| EP | 1282088 | 2/2003 |
| EP | 1462152 | 9/2004 |
| EP | 1492063 | 12/2004 |
| EP | 1524617 | 4/2005 |
| EP | 1610275 | 12/2005 |
| GB | 1464896 | 2/1977 |
| GB | 2120506 | 11/1983 |
| WO | WO/98/52665 | 11/1998 |
| WO | WO/98/56475 | 12/1998 |
| WO | WO/99/10849 | 3/1999 |
| WO | WO/99/42889 | 8/1999 |
| WO | WO/99/44095 | 9/1999 |
| WO | WO/01/15127 | 3/2001 |
| WO | WO/01/15128 | 3/2001 |
| WO | WO/01/15132 | 3/2001 |
| WO | WO/01/09664 | 8/2001 |
| WO | WO/02/073501 | 9/2002 |
| WO | WO/03/023647 | 3/2003 |
| WO | WO/03/028830 | 4/2003 |
| WO | WO/03/039699 | 5/2003 |

(56) References Cited

FOREIGN PATENT DOCUMENTS

| | | |
|---|---|---|
| WO | WO/03/041825 | 5/2003 |
| WO | WO/2004/001486 | 12/2003 |
| WO | WO/2004/102520 | 11/2004 |
| WO | WO/2006/033986 | 3/2006 |
| WO | WO/2006/034192 | 3/2006 |
| WO | WO/2006/038819 | 4/2006 |
| WO | WO/2006/039132 | 4/2006 |
| WO | WO/2007/032916 | 3/2007 |
| WO | WO/2007/040413 | 4/2007 |
| WO | WO/2007/120444 | 10/2007 |
| WO | WO/2007/120450 | 10/2007 |
| WO | WO/2008/061068 | 5/2008 |
| WO | WO/2008/112783 | 9/2008 |
| WO | WO/2009/009269 | 1/2009 |
| WO | WO/2009/036445 | 3/2009 |
| WO | WO/2009/140096 | 11/2009 |
| WO | WO/2009/143274 | 11/2009 |
| WO | WO/2010/056418 | 5/2010 |
| WO | WO/2010/120451 | 10/2010 |

OTHER PUBLICATIONS

"Service Window Systems," IGT, 2011, 1 page.
en.wikipedia.org/wiki/Thin_client; "Thin client," Wikipedia.org, retrieved Jun. 19, 2012, 5 pages.
gaming.hermes-softlab.com/gaming_vendors/g2s_protocol/protocol_stack.asp; "G2S Protocol-Stack," ComTrade Gaming Competence Center, retrieved May 16, 2012, 2 pages.
http://reviews.cnet.com/8301-12261_7-57 433025-1 0356022/ericsson-could-turn-you-into-a-human-usb-connection-next-year/; "Ericsson Could Turn You Into a Human USB Connection Next Year," CNET Reviews, retrieved Sep. 10, 2012, 10 pages.

PLAYER DRIVEN GAME DOWNLOAD TO A GAMING MACHINE

PRIORITY CLAIM

This application is a continuation of, claims priority to and the benefit of U.S. patent application Ser. No. 13/609,505, filed on Sep. 11, 2012, the entire contents of which is incorporated by reference herein.

BACKGROUND

1. Field of the Described Embodiments

The present disclosure relates generally to gaming machines, and more particularly to gaming machines configured to allow players to request and download games dynamically to the gaming machines.

2. Description of the Related Art

Many of today's gaming casinos and other entertainment locations feature different single and multi-player gaming machines such as slot machines and video poker machines. The gaming machines may include a number of hardware and software components to provide a wide variety of game types and game playing capabilities. Exemplary hardware components may include bill validators, coin acceptors, card readers, keypads, buttons, levers, touch screens, coin hoppers, ticket printers, player tracking units and the like. Software components may include, for example, boot and initialization routines, various game play programs and subroutines, credit and payout routines, image and audio generation programs, various component modules and a random or pseudo-random number generator, among others.

Gaming machines are highly regulated to ensure fairness. In many cases, gaming machines may be operable to dispense monetary awards of a large amount of money. Accordingly, access to gaming machines is often carefully controlled. For example, in some jurisdictions, routine maintenance requires that extra personnel (e.g., gaming control personnel) be notified in advance and be in attendance during such maintenance. Additionally, gaming machines may have hardware and software architectures that differ significantly from those of general-purpose computers (PCs), even though both gaming machines and PCs employ microprocessors to control a variety of devices. For example, gaming machines may have more stringent security requirements and fault tolerance requirements. Additionally, gaming machines generally operate in harsher environments as compared with PCs.

SUMMARY

According to one embodiment, a method of providing a game to a gaming machine includes providing a service window to a gaming machine. The service window includes an option to request an available game. The method also includes receiving, at the processing circuit, a request for the game from the gaming machine via the service window. The method further includes providing the requested game to the gaming machine.

According to another embodiment, a processing circuit is configured to provide a service window to a gaming machine. The service window includes an option to request an available game. The processing circuit is further configured to receive a request for the game from the gaming machine via the service window and to provide the requested game to the gaming machine.

According to another embodiment, a method of providing a game to a gaming machine includes determining, by a processing circuit, that a game is available for download to a gaming machine. The method also includes providing a service window to a gaming machine, the service window including an option to request the available game. The method further includes receiving, at the processing circuit, a request for the game from the gaming machine via the service window. The method also includes providing the requested game to the gaming machine.

BRIEF DESCRIPTION OF THE DRAWINGS

The details of one or more embodiments are set forth in the accompanying drawings and the description below. Other features, aspects, and advantages of the disclosure will become apparent from the descriptions, the drawings, and the claims, in which:

DETAILED DESCRIPTION

Numerous specific details may be set forth below to provide a thorough understanding of concepts underlying the described embodiments. It may be apparent, however, to one skilled in the art that the described embodiments may be practiced without some or all of these specific details. In other instances, some process steps have not been described in detail in order to avoid unnecessarily obscuring the underlying concept.

Figure 1:
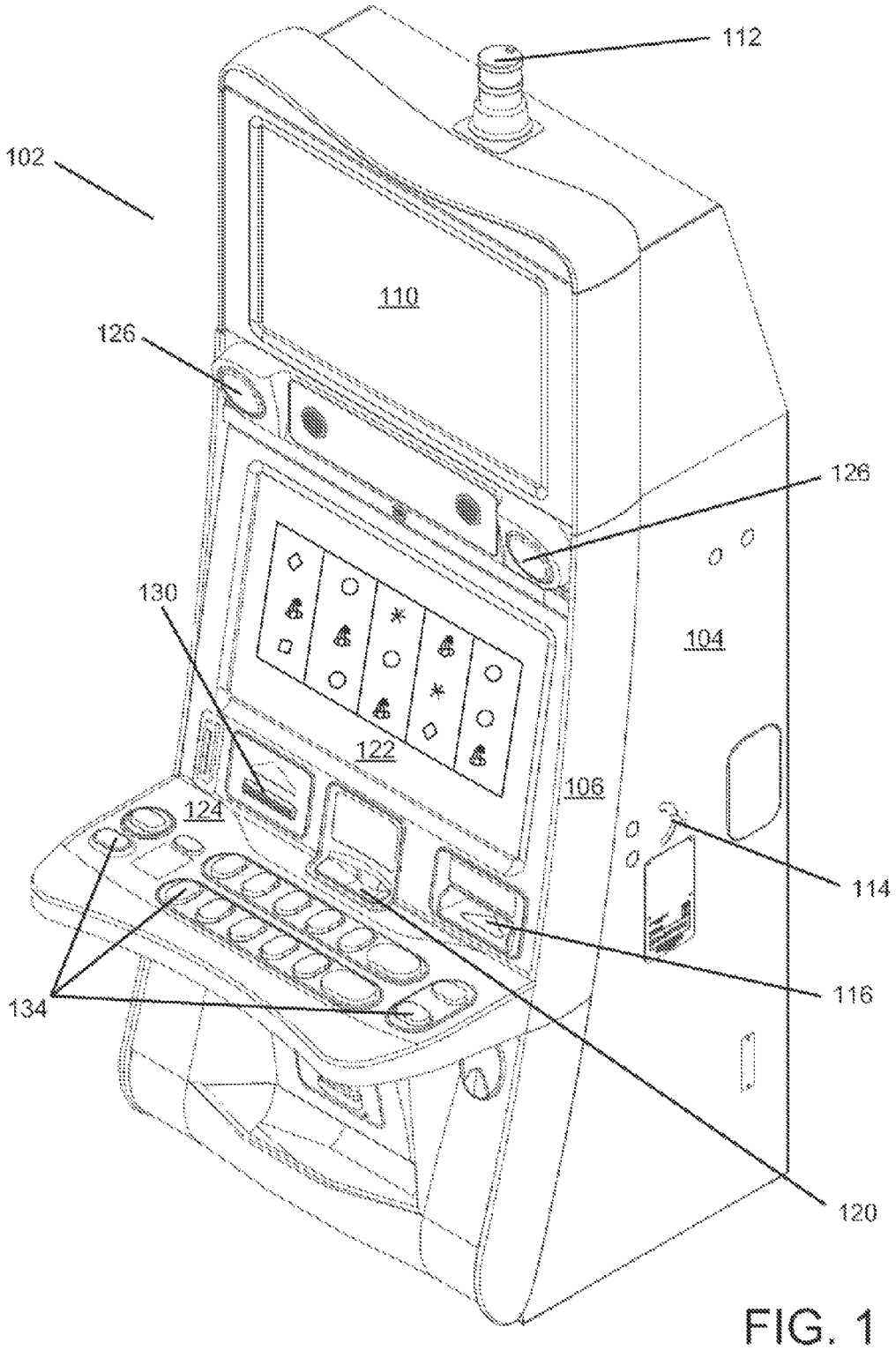
FIG. 1 is an illustration of a gaming machine, according to an exemplary embodiment.

Referring to FIG. 1, a perspective drawing of an electronic gaming machine 102 is shown in accordance with described embodiments. Gaming machine 102 may include a main cabinet 104. Main cabinet 104 may provide a secure enclosure that prevents tampering with device components, such as a game controller (not shown) located within the interior of main cabinet 104. Main cabinet 104 may include an access mechanism, such as a door 106, which allows the interior of gaming machine 102 to be accessed. Actuation of a door 106 may be controlled by a locking mechanism 114. In some embodiments, locking mechanism 114, door 106, and the interior of main cabinet 104 may be monitored with security sensors of various types to detect whether the interior has been accessed. For instance, a light sensor may be provided within main cabinet 104 to detect a change in light-levels when door 106 is opened and/or an accelerometer may be attached to door 106 to detect when door 106 is opened.

Gaming machine 102 may include any number of user interface devices that convey sensory information to a user and/or receive input from the user. For example, gaming machine 102 may include electronic displays 110, 122, speakers 126, and/or a candle device 112 to convey information to the user of gaming machine 102. Gaming machine 102 may also include a console 124 having one or more inputs 134 (e.g., buttons, track pads, etc.) configured to receive input from a user. In one embodiment, display 110 and/or display 122 may also be a touch screen display configured to receive input from a user. A controller (not shown) within gaming machine 102 may run a game, such as a wager-based game, in response to receiving input from a user via inputs 134, display 122, or display 110. For example, inputs 134 may be operated to place a wager in the game and to run the game. In response, the controller may cause reels shown on display 122 to spin, such as with a software-based slot game.

Gaming machine 102 may also include devices for conducting a wager-based game. For example, gaming machine 102 may include a ticket acceptor 116 and a printer 120. In various embodiments, gaming machine 102 may be configured to run on credits that may be redeemed for money and/or other forms of prizes. Ticket acceptor 116 may read an inserted ticket having one or more credits usable to play a game on gaming machine 102. For example, a player of gaming machine 102 may wager one or more credits within a video slot game. If the player loses, the wagered amount may be deducted from the player's remaining balance on gaming machine 102. However, if the player wins, the player's balance may be increased by the amount won. Any remaining credit balance on gaming machine 102 may be converted into a ticket via printer 120. For example, a player of gaming machine 102 may cash out of the machine by selecting to print a ticket via printer 120. The ticket may then be used to play other gaming machines or redeemed for cash and/or prizes. According to various embodiments, gaming machine 102 may record data regarding its receipt and/or disbursement of credits. For example, gaming machine 102 may generate accounting data whenever a result of a wager-based game is determined. In some embodiments, gaming machine 102 may provide accounting data to a remote data collection device, allowing the remote monitoring of gaming machine 102.

In one embodiment, gaming machine 102 may include a loyalty card acceptor 130. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing gaming machine 102. For example, a user having a loyalty account may be given a bonus turn on gaming machine 102 or credited loyalty points for playing gaming machine 102. Such loyalty points may be exchanged for loyalty rewards (e.g., a free meal, a free hotel stay, free room upgrade, discounts, etc.).

Figure 2:
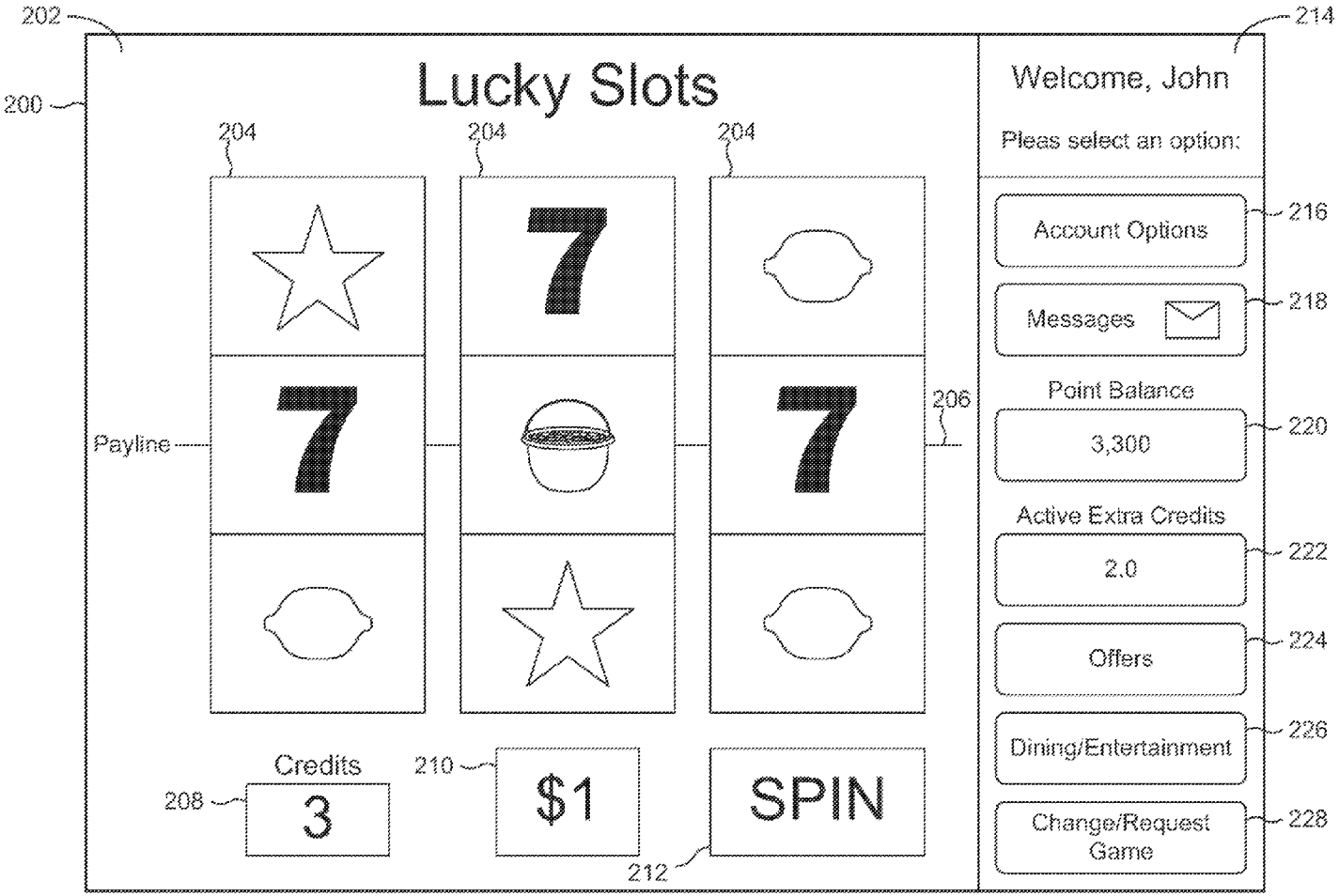
FIG. 2 is an illustration of a service window being displayed by a gaming machine, according to an exemplary embodiment.

Referring now to FIG. 2, an illustration of a service window 214 on a gaming machine is shown, according to an exemplary embodiment. Generally, a service window refers to any graphical interface that provides entertainment-related services to a player of a gaming machine, information regarding the player's loyalty account, and/or allows messages to be sent to the player. Typically, a service window may be displayed by a gaming machine in conjunction with a running game (e.g., at the same time), but may also be displayed separately (e.g., when no game is running).

As shown, a gaming machine may include an electronic display 200 in communication with one or more processors of the gaming machine. The one or more processors may execute machine instructions that cause the one or more processors to provide display data to electronic display 200. In one embodiment, electronic display 200 may be a touch screen display configured to provide input data to the one or more processors of the gaming machine, in response to detecting contact with the screen.

For example, electronic display 200 may detect a change in resistance, capacitance, or a similar measurement, due to contact being made with electronic display 200. Such a measurement may be used by the one or more processors as input to a game or other application executed by the gaming machine (e.g., as a selection of a displayed icon or button, as a swiped motion across the screen, etc.).

According to some embodiments, service window 214 may be provided to display 200 by a multimedia player application executed by the gaming machine. For example, service window 214 may be presented to display 200 by the Flash Player application by Adobe Systems, Inc., or by another similar multimedia player. In other embodiments, service window 214 may be a webpage presented to display 200 by a web browser. In some embodiments, service window 214 may be generated and provided to the gaming machine by a remote server. In other words, the logic of service window 214 may reside on a remote server and its corresponding display data provided to the gaming machine for presentation to the player. In other embodiments, the logic of service window 214 may reside within a local memory of the gaming machine as a stand-alone application or as a multimedia application.

Service window 214 may be provided to the gaming machine via any of a variety of gaming protocols (i.e., communications protocols specifically designed for use in a gaming environment, such as a casino), or any of a variety of non-gaming protocols (i.e., communication protocols that are not specifically designed for use in a gaming environment). One exemplary gaming protocol is the Slot Accounting System (SAS) Protocol, pioneered by International Game Technology (IGT) and recognized in 2002 by the Gaming Standards Association (GSA) as an industry standard. A more recent gaming communications protocol in the gaming industry is the Game to System (G2S) Protocol, also recognized by the GSA as an industry standard. Thus, many casinos and other gaming environments may have specialized infrastructure to support the control and monitoring of gaming machines. Exemplary non-gaming protocols may include, but are not limited to, HTML, RTMP, FTP, JSON, and the like.

According to some embodiments, service window 214 may be provided to electronic display 200 in conjunction with a running game 202. Service window 214 may be presented on electronic display 200 along a border of electronic display 200 with game 202 or in another on-screen location. Game 202 may be a wager-based game and may display a cost 210 associated with playing game 202. For example, each round of game 202 may cost $1. Game 202 may also use credits to represent an amount of money available to wager. In some cases, money inserted into the gaming machine may be converted into credits. In other cases, credits may be associated with a player's account and registered with the gaming machine when a loyalty card is inserted into the gaming machine. Game 202 may display the number of credits available to a player via a box 208. Such credits may be used to play game 202 or may be cashed out by converting the credits directly into cash, a redeemable ticket, or stored as part of the player's loyalty account.

In further embodiments, service window 214 may be provided in a separate window as game 202 or even on a display of a separate device. For example, game 202 may be minimized or otherwise hidden to display service window 214. In another example, service window 214 may be displayed on a portable electronic device operated by the player, such as a smartphone or tablet computing device. Such an electronic device may communicate with a remote server to identify the player wirelessly or via a connection with the gaming machine. For example, a portable device may communicate with the gaming machine via a Bluetooth connection, a WiFi connection, a cellular connection (e.g., 4G LTE), a docking station, a universal serial bus (USB) cable, or any other form of wireless or wired connection. In one embodiment, a connection may be formed by a player's own body presenting a low voltage electrical path that connects the portable device and the gaming machine.

In the example shown, game 202 may be a slot game that includes reels 204 that are displayed by display 110 and/or 122 and simulate the spinning of reels in an electro-mechanical slot machine. Each of reels 204 may include any number of symbols (e.g., lemons, 7's, stars, pots of gold, etc.). Game 202 may also include a payline 206. To play game 202, a player may select a spin button 212, thereby wagering one or more of his or her available credits. In response, the game may randomly determine an outcome for payline 206 and simulate the spinning of reels 204. If a certain number of symbols and/or specific types of symbols align along payline 206, the player of the gaming machine may receive credits.

In some embodiments, service window 214 may be associated with a player's loyalty account. For example, a player may identify him or herself to the gaming machine by inserting a loyalty card into a reader, providing biometric data to the gaming machine, or bringing another electronic device into proximity of the gaming machine (e.g., a cellular phone, an RFID tag, etc.). Identification data may then be provided by the gaming machine to the remote server, which stores account information for the player (e.g., information regarding the player's name, address, drink preferences, earned rewards, loyalty points, etc.). Service window 214 may provide indications of such account information to display 200 for review by the player of the gaming machine.

Service window 214 may include an indication 220 of earned loyalty points associated with the player's loyalty account. In general, loyalty points provide an incentive to a player to continue playing the gaming machine. Loyalty points may be earned by the player based on the amount of time the player has played the gaming machine, the number of rounds of game 202 played by the player, the amount of the player's wagers, or similar factors. Loyalty points may be redeemed by the player for discounts, prizes, meals, drinks, hotel stays, goods, services, tickets, or any other form of reward.

Service window 214 may include an indication 222 of earned extra credits. Extra credits may be used by a player to supplement the credits indicated by box 208 of game 202. For example, a player may earn a free spin in game 202 based on the amount of play of game 202, randomly, or in response to the player performing a desired action.

Service window 214 may include a menu option 216 to allow a player to update his or her account information. Selection of option 216 may navigate the player to one or more other screens of service window 214 to update his or her account information. For example, option 216 may be selected by a player to add, update, or delete information regarding the player (e.g., the player's contact information, the player's preferences, etc.).

Service window 214 may include a menu option 218 configured to allow a player of the gaming machine to review messages. In some cases, messages may be provided by the operator of the gaming establishment to the player of the gaming machine. For example, a casino operator may notify players of upcoming events, promotions, etc., via messages 218. If the player has a registered loyalty account, messages 218 may also include messages specific to the player (e.g., awards given to the player, confirmations of loyalty point redemptions, etc.). The messages may be sent by the operator of the gaming establishment, an advertiser, another player, or any other entity. Similarly, service window 214 may be configured to allow the player to send messages to other players, staff of the establishment, etc. For example, service window 214 may include a message inbox and/or outbox, to allow the player of the gaming machine to receive and/or send messages to others.

Service window 214 may include a menu option 224 configured to allow a player to review currently available offers. Similar to promotional offers sent via messages, the offers may include available opportunities to earn or redeem loyalty points, discounts from the operator of the gaming environment or another such entity, participate in special contests, etc. The promotional offers available via menu option 224 may be provided on a "pull" basis (i.e., in response to a request from the player for promotional offers), while any promotional offers available via menu option 224 may be provided on a "push" basis (i.e., without first receiving a request from the player). In various embodiments, the promotional offers may be generally-available offers or offers available only to a particular player or set of players.

Service window 214 may include a menu option 226 to allow the player of the gaming machine perform entertainment-related functions. For example, the player may select menu option 226 to make, cancel, and/or change reservations at a restaurant. In another example, menu option 226 may allow the player to purchase tickets to a show (e.g., a movie, play, musical, concert, etc.) or place a reservation with a particular restaurant. In cases in which service window 214 is associated with a loyalty account, menu option 226 may also be configured to allow an account holder to redeem loyalty points at a restaurant or to purchase tickets.

In some cases, one or more games may be loaded to the gaming machine by a technician or similar individual associated with the gaming environment. For example, game 202 may be installed to a memory of the gaming machine during maintenance by a casino employee. Different games may be installed on the gaming machine for any number of reasons. In one example, the games installed on a gaming machine may be changed periodically, to retain the interests of players. In another example, a casino employee may install a certain game to a row of gaming machines, allowing players to easily seek out the game in the casino. However, the set of one or more games installed on the gaming machine in this way may be static in nature from the perspective of a player. In other words, the set of games on a gaming machine may be available to a player on a take it or leave it basis. If a player does not like the games installed on the gaming machine, the player may only play the machine for a short amount of time or may not even play the machine at all.

According to various embodiments, service window 214 may include menu option 228 configured to allow the player of the gaming machine to request a new game to be playable on the gaming machine. In some embodiments, menu option 228 may be available in service window 214 to all players. In other embodiments, menu option 228 may be available in service window 214 based on a player's loyalty account, a parameter that controls whether menu option 228 is available on the gaming machine, or other such factors.

Figure 3:
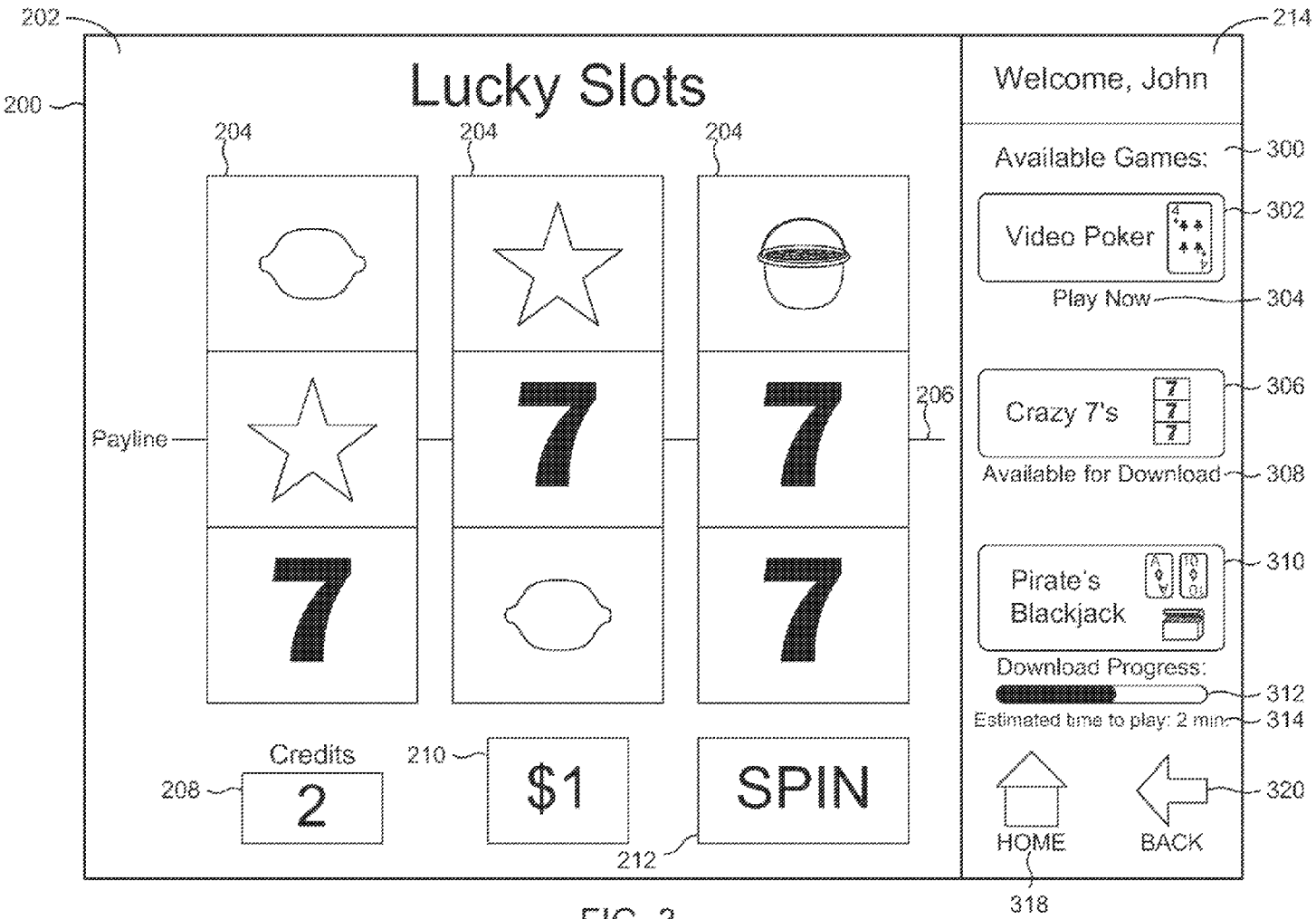
FIG. 3 is an illustration of a game menu on a gaming machine, according to an exemplary embodiment.

Referring now to FIG. 3, an illustration of a game menu 300 on a gaming machine is shown, according to an exemplary embodiment. Game menu 300 may be presented on the gaming machine in response to selection of menu option 228 shown in FIG. 2. In other words, a player of the gaming machine may request to view the games available for download and play on the gaming machine. Game menu 300 may include various options to return to other menus of service window 214. For example, game menu 300 may include a back button 320 to return to the previous screen and/or a home button 318 to return to the topmost menu of service window 214.

As shown, menu 300 may include game options 302, 306, 310 to request various games. For example, game option 302 may be selected to request a video poker game, game option 306 may be selected to request another slot-based game, and game option 310 may be selected to request a blackjack game. Menu 300 may include any number of game options on one or more screens, to allow a player of the gaming machine to request and/or play a game.

Menu 300 may include various status indicators 304,308, and 312-314 for game options 302, 306, 310, respectively. A status indicator may indicate whether a game is available for download, whether the game has already been downloaded and is available for play on the gaming machine, whether a requested game has completed downloading, the amount of time needed to validate a downloaded game, when a requested game will be available for play, and similar statuses. For example, status indicator 304 may indicate that the video poker game associated with game option 302 is available to play immediately (e.g., the game has already been downloaded to the gaming machine and validated). Status indicator 308 may indicate that the slot game associated with game option 306 is available for download. In some cases, a status indicator may indicate where a game is available, if the game is unavailable at the current gaming machine.

Status indicators 312, 314 may provide information regarding the status of a requested game. For example, assume that game option 310 was selected to request the blackjack game for download to the gaming machine. In such a case, status indicator 312 may show the download status of the game and status indicator 314 may provide an estimated amount of time until the game is ready to be played (e.g., after completion of its download and validation). In one embodiment, game 202 may continue to be played while the blackjack game is downloaded. After download and validation of the game, a notification may then appear within service window 214 to notify the player that the game is now available for play on the gaming machine.

Any number of factors may be used to control which games are available via game menu 300. In one embodiment, the games available via game menu 300 may include the entire library of games available from a remote server. In another embodiment, game menu 300 may include games corresponding to certain theme (e.g., slot games, poker games, etc.), games within a particular bundle of games, or a similar grouping of games. In one embodiment, the games available via game menu 300 may be based in part on a parameter for the gaming machine. For example, a casino operator may configure one or more parameters to control which games are available on gaming machines at different locations within the casino.

In some embodiments, the games available via game menu 300 may be based in part on a player's loyalty account. Different games may be available to different players based on their level of play, amount of wagers, loyalty tier levels (e.g., silver members, gold members, high rollers, etc.), or other factors. For example, the newest and hottest games may only be available to players having a gold loyalty membership or higher. In one embodiment, games available via game menu 300 may be "unlocked" (e.g., become available for download) based on a player accumulating a certain amount of wagers, playtime, loyalty points, extra credits, or one or more in-game achievements. In another embodiment, loyalty points may be redeemed by a player to unlock a game or set of games. In a further embodiment, a player's account may be limited to a certain number of downloads (e.g., five downloads per day, ten downloads per day, etc.) and/or to certain download rates (e.g., 10 MB/s, 100 MB/s, etc.). For example, a high roller may be allowed to download more games and at a faster rate than a basic loyalty member. Limiting the number of downloads per user and/or their respective download rates may help to prevent denial of service attacks and to incentivize players to perform certain actions.

The games available via game menu 300 may include suggested games for a player. Games may be suggested, for example, via an ordering of game options on game menu 300 (e.g., suggested games may appear first in game menu 300). In some cases, game menu 300 may include additional indicia to denote suggested games. For example, a menu option for a suggested game may have an associated coloring, icon, or text that signifies that the game is a suggested game. In some embodiments, game suggestions may appear within a message sent to the player via service window 214 or on a separate menu from game menu 300. For example, service window 214 may include a separate menu option for a player to review suggested games.

Game suggestions may be based on a player's previous gaming experiences in the gaming environment and/or elsewhere. Data regarding the games played by the player may be recorded and associated with the player's account. In one embodiment, data regarding a player's use of online games may be recorded and used to suggest games to the player via game menu 300. The online games may or may not be wager-based games (e.g., social based online gaming). For example, the player may play the game, "Poker ABC," via his loyalty account at home and prior to visiting a casino. When the player visits the casino, game menu 300 may include an option for the player to download "Poker ABC" to the gaming machine or another poker-themed game, based on his playing the online poker game. Similarly, data regarding the games played by the player while in the gaming environment may be recorded and used to suggest games via game menu 300. For example, game option 306 may be presented as part of game menu 300 based on the player playing game 202, since both are slot-related games. In further embodiments, a game may be played by a player in one casino and included as an option on game menu 300 while at another casino.

In some cases, games installed on a gaming machine may be pre-selected by the operator of a gaming environment. For example, a casino operator may purchase a license for a particular game and install the game to a gaming machine located in the casino. In other words, games may be provided to a gaming machine in a "push" manner. In contrast, game menu 300 allows games to be requested and provided to a gaming machine in a "pull" manner. For example, a player that plays one game at first casino may request that the game be made available at a gaming machine at a second casino. Thus, the selection of games that are installed and played at a gaming machine may be driven by player demand, as opposed to being selected by the operator of the gaming environment.

A game may also be suggested based in part on other factors, such as its release date, its amount of player usage, the amount wagered in the game by players, to correspond with a event (e.g., a movie release, a news event, a sporting event, etc.). For example, a baseball-themed game may be suggested during the World Series. In another example, a science fiction-themed game may be suggested when a new movie is released about robots.

According to various embodiments, game suggestions may be based in part on suggestions made by other players. For example, service window 214 may be configured to allow a player to recommend that one or more other players play a particular game. In one embodiment, players may be able to link their player accounts as part of a social networking circle. In such a case, games played by one player may be used to suggest games to the player's social connections. For example, a slot game may be suggested to a player's friend based in part on his or her playing of the game. In some embodiments, achievement awards may be granted to a player via service window 214 and shared with the player's social contacts. For example, a player may be granted a token, trophy, or avatar based on a certain in-game achievement (e.g., receiving a large payout or jackpot, receiving a certain sequence of outcomes in the game, etc.). In such cases, other players may receive indications of the awards via service window 214. In other words, one or more other players may be notified about granted achievement awards to encourage them to play the corresponding game.

Various billing models may be used by the game manufacturer to bill the operator of the gaming environment. In one example, the use of the different games by players may be recorded and used to bill the operator of the gaming environment (e.g., based on the individual game usage patterns). In another example, the game manufacturer may charge the operator on a per-download basis or on a per-play basis. In some cases, a game manufacturer may allow the operator a certain number of free uses of the game, so that metrics may be obtained regarding use of the game (e.g., how popular the game is with new players). For example, the game manufacturer may allow the game to be played by one hundred players so that such usage metrics may be obtained.

Site licenses may be sold to the operator of the gaming environment for a particular game or set of games. For example, an operator of a gaming environment may purchase thirty licenses for a particular slot game. In such a case, the number of licenses may be compared to the number of gaming machines on which the game is being played, to determine whether there are any licenses available. If a license is available, the game may be downloaded via game menu 300. If not, game menu 300 may notify a player that no licenses are available and/or place the player in a queue until a license becomes available.

Figure 4:
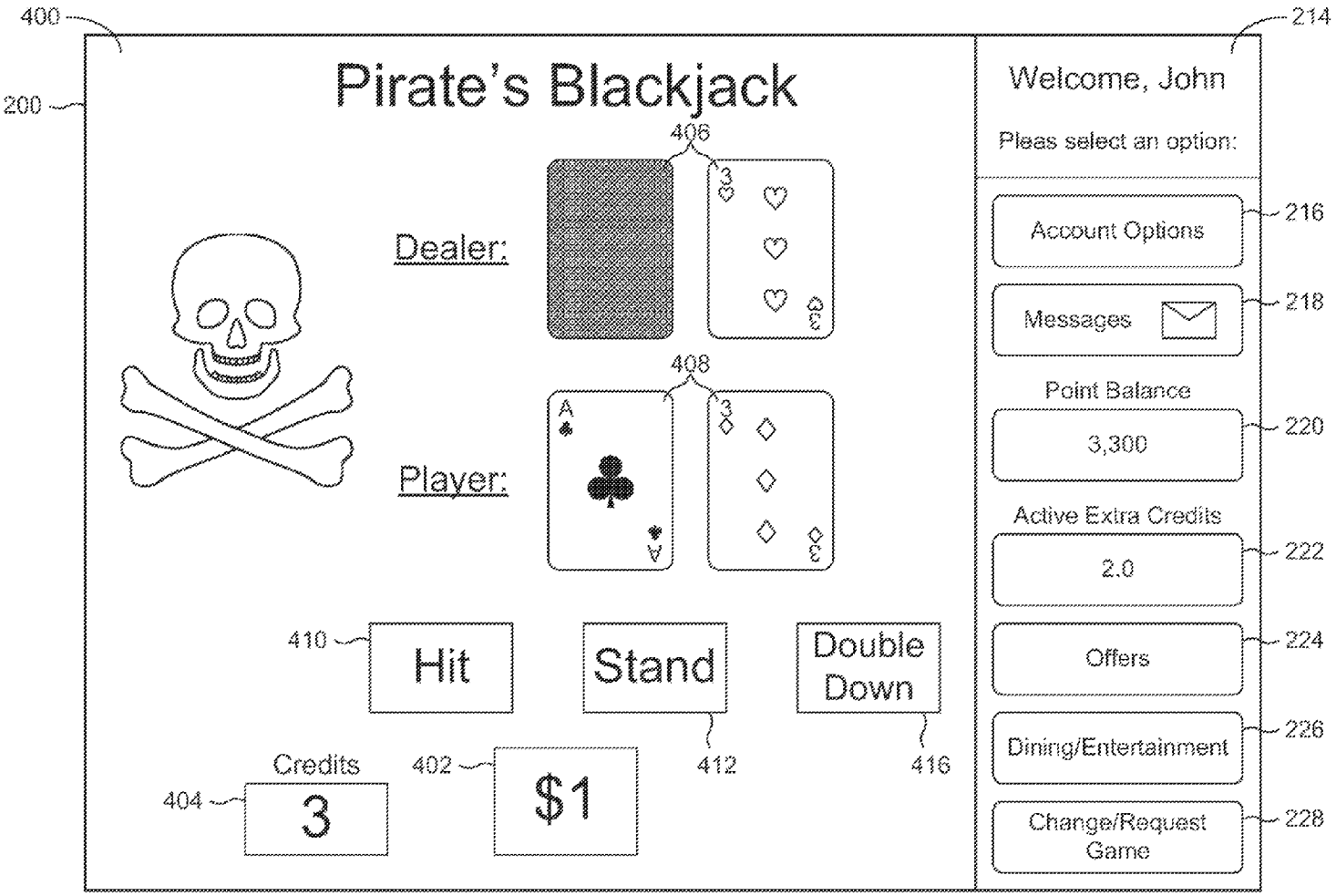
FIG. 4 is an illustration of a downloaded game being played on a gaming machine, according to various embodiments.

Referring now to FIG. 4, an illustration of a downloaded game 400 being played on a gaming machine is shown, according to various embodiments. In one example, game 400 may be downloaded in response to a selection of game option 310 on game menu 300, as shown in FIG. 3. After completion of the download and/or validation of game 400, a player of the gaming machine may be prompted with a notification that game 400 is now available for play. Such a notification may be accompanied by a selectable option to play game 400. If such an option is selected, the current game may be updated from being game 202 to being game 400. As shown, game 400 may also be provided in conjunction with service window 214 in a manner similar to that of game 202.

Game 400 may be a wager-based game and include indicia 402 regarding the amount of a basic wager in game 400 (e.g., $1 per hand). Game 400 may also include indicia 404 regarding the number of credits available to the player (e.g., the player may have $4 worth of credits remaining). As shown, game 400 may be a blackjack-based game and include a dealer's hand 406 and a player's hand 408. Game 400 may further include options 410, 412, and 416 to allow the player to perform black-jack related functions, such as hitting (e.g., to receive another card), standing (e.g., to keep the current hand as-is), or doubling down (e.g., to double the wager and receive an additional card).

Figure 5:
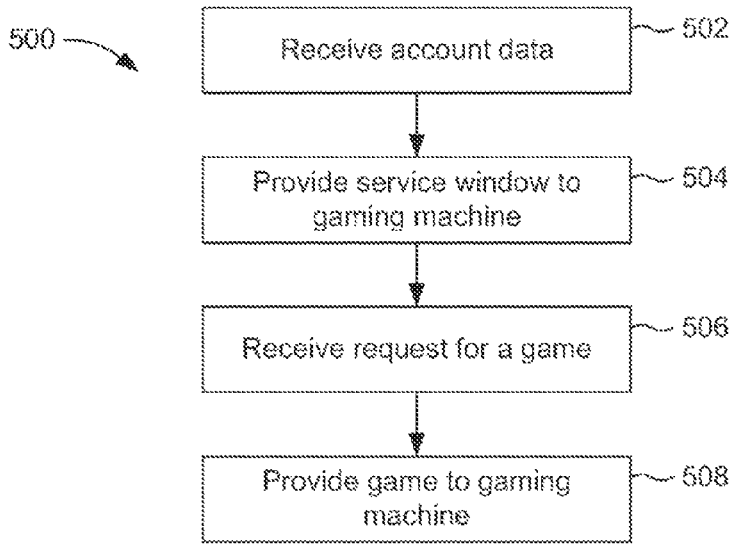
FIG. 5 is a flow diagram of a process for providing a game to a gaming machine.

Referring now to FIG. 5, a flow diagram of a process 500 for providing a game to a gaming machine is shown, according to various embodiments. Process 500 may be implemented using any number of computing devices. For example, process 500 may be implemented by a server in communication with one or more gaming machines by executing stored machine instructions. For example, the server may be a server within a gaming environment in communication with a gaming machine via a local area network (LAN) or a remote server in communication with the gaming machine via the Internet (e.g., the server may be a server of a game manufacturer, a cloud-computing server, etc.).

Process 500 includes receiving account data (block 502). In various embodiments, the account data may be data regarding a player's loyalty account. For example, the account data may include identification information to log into the player's account, such as the player's name, a unique string of characters, a screen name, an alias, or the like. The account data may also include security data, such as encryption data, a password, a device serial number, or the like. The loyalty account may be associated with a particular gaming environment (e.g., a casino, a racetrack, etc.), game manufacturer, combinations thereof, or other such entities.

In some cases, the account data may be received from a gaming machine. For example, data regarding a player's identity may be communicated to a server in response to the player inserting a loyalty card into a gaming machine. In other cases, data indicative of the player's identity may be communicated from a portable electronic device operated by the player (e.g., via a connection with the gaming machine, directly to the server, etc.). For example, a player may operate a cell phone application to register him or herself with a gaming machine or when located in a gaming environment. In a further embodiment, a player may manually enter the account data into a gaming machine or other such device, which then communicates the data to a server. For example, a player that forgot her loyalty card may identify herself by entering her phone number and zip code into a gaming machine.

Process 504 includes providing a service window to a gaming machine (block 504). In various embodiments, the server receiving the account data may provide a service window to a gaming machine. In other embodiments, the service window may be provided to a portable electronic device or other device in communication with a gaming machine. For example, the service window may be provided to a player's cellular phone or tablet computer when in proximity of a gaming machine.

The service window may be configured to display data regarding a player's loyalty account, such as the number of available loyalty points, the player's name, or the number of available bonus credits. The service window may also allow a player to change his or her contact information, register a favorite drink, earn loyalty points, redeem loyalty points, earn and use bonus credits, pay taxes on large payouts, make reservations, purchase tickets, review promotional offers, participate in social gaming activities, receive and/or send messages with other individuals, any combination thereof, or perform other functions. According to various embodiments, the service window may be configured to allow a player to request a game for download to the gaming machine. For example, the service window may display games available for download to the gaming machine and include one or more options to request that a game be downloaded.

In some embodiments, the number and types of games available may be based in part on the gaming machine or other device to which the service window is provided. A game's availability may be based in part on the location of the gaming machine. For example, only games approved by a government body for play in a location may be provided to a gaming machine located there. In another example, a game may only be available to certain machines within a casino or other gaming environment (e.g., only slot-based games may be downloaded to a particular row of gaming machines).

The number and type of games available may also be based in part on the licensing terms of a game manufacturer. In one embodiment, the availability of a game may be based on whether a site license is currently available. For example, a casino may have forty site licenses for the game "Pirate's Blackjack." If the game is in use by thirty nine or less gaming machines, it may be available for play. However, if the game is in use by forty gaming machines, it may be unavailable. In another embodiment, only certain games may be licensed by the operator of the gaming environment and made available to gaming machines in the environment. For example, a casino operator may license a set of poker-themed games from a game manufacturer, but not a set of slot-themed games. In such a case, only the poker-themed games may be made available for download to a gaming machine. In a further embodiment, a game may be available based on a limited-use license. For example, a game may be available under a trial license or a license that expires after a certain period of time. In further embodiments, a portion or all of a game manufacturer's library may be available. In such cases, the game manufacturer may charge the operator of the gaming environment based on the amount of use of a game, the amount of wagers placed in the game, or using similar metrics.

The number and type of games available for download and play by a gaming machine may be based in part on a player's loyalty account. In some embodiments, the number and/or types of games available to a loyalty account may be based on a membership level of the account (e.g., a gold account vs. a platinum account), the number of loyalty points associated with the account, the number of visits to the gaming environment by the player, the player's demographics (e.g., age, gender, etc.), or other account data. In one embodiment, a game may be "unlocked" by a player by redeeming loyalty points and/or by earning certain in-game achievements. In other words, one game may become available to a player through playing another game.

The games available via the service window may include game suggestions. Games may be suggested based in part on a player's use of certain games. For example, a slot-based game may be suggested to a player that primarily plays slot-based games (e.g., online, in a gaming environment, etc.). Games may also be suggested based on certain events, such as a sporting event, movie release, etc. In other cases, a game may be suggested based on its release date and/or popularity. For example, the most popular or newest games may be suggested via the service window. Games may also be suggested by social connections. For example, one player may recommend a game to another player. A suggested game may also be a game that was played, or is being played, by a player's friend. For example, a suggested game may be a game that allows two or more players to collaborate in-game (e.g., to earn awards or prizes, to win the game, etc.). If one player begins playing such a game, the game may appear as a suggestion to the other player via the service window.

Process 500 includes receiving a request for a game (block 506). A game request may be received by the remote server that provided the service window. For example, a player may request a game by selecting a game option within the service window. In one embodiment, the number of download requests may be limited within a period of time (e.g., per day, per week, etc.) or permanently limited. For example, a player may be restricted to five game downloads per day. In some cases, the limit may be based in part on the type of loyalty account. For example, the number of game downloads per day may be more limited for a gold level account than for a platinum level account.

Process 500 includes providing the game to the gaming machine (block 508). In some embodiments, the download speed of the game may be based in part on the loyalty account. For example, the download speed may be higher for a platinum level account than for a gold level account. In some embodiments, a player may redeem loyalty points for a higher download speed. The service window may provide an estimation of the remaining download time and/or the time until the game is playable (e.g., if the game also requires validation after being downloaded).

Figure 6:
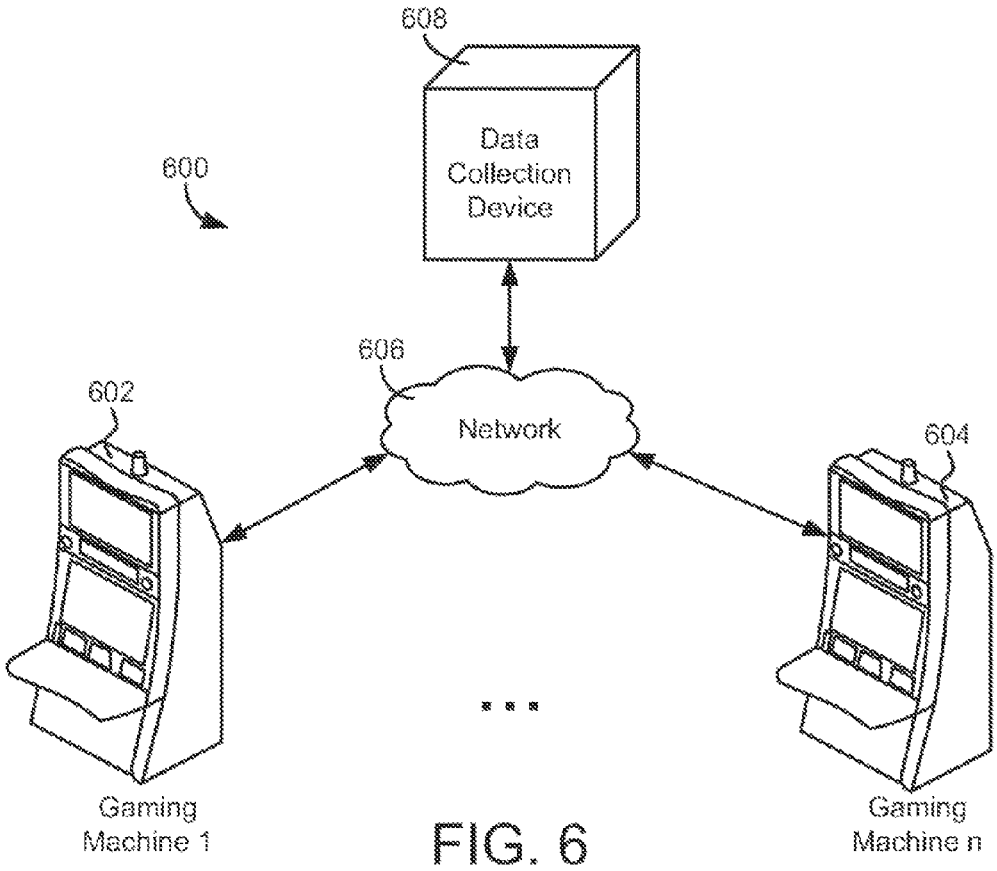
FIG. 6 is an illustration of a gaming system, according to various embodiments.

Referring now to FIG. 6, an illustration of a gaming system 600 is shown, according to an exemplary embodiment. As shown, gaming system 600 may include any number of gaming machines. For example, gaming system 600 may include gaming machines 602-604 (i.e., a first gaming machine through nth gaming machine). Gaming system 600 may also include a network 606 through which gaming machines 602-604 communicate with a server 608. In some embodiments, gaming machines 602-604 may also communicate with each other via network 606.

Network 606 may be any form of communications network that conveys data between gaming machines 602-604 and server 608. Network 606 may include any number wired or wireless connections. For example, server 608 may communicate over a wired connection that includes a serial cable, a fiber optic cable, a CAT5 cable, or any other form of wired connection. Similarly, server 608 may communicate via a wireless connection (e.g., via WiFi, cellular, radio, etc.). Network 606 may also include any number of intermediary networking devices, such as routers, switches, servers, etc.

In various embodiments, gaming machines 602-604 and server 608 may communicate via network 606 using a gaming protocol. For example, the devices may communicate using the SAS Protocol or G2S Protocol. In some cases, multiple gaming protocols may be used to communicate data between server 608 and gaming machines 602-604. For example, gaming machine 602 may communicate via the SAS Protocol with an SAS<->G2S Protocol converter that is part of network 606, which converts the message into the G2S Protocol and forwards the message to server 608. Gaming machines 602-604 may also communicate with server 608 or other electronic devices via network 606 using non-gaming protocols. For example, gaming machines 602-604 may communicate with server 608 via HTTP, FTP, DHCP, or another communications protocol that is not specifically designed for use by electronic gaming machines.

Server 608 may be one or more electronic devices connected to network 606 configured to communicate with gaming machines 602-604. For example, server 608 may be a single computer, a collection of computers, or a data center. Server 608 may include one or more data storage devices in communication with one or more processors. The data storage devices may store machine instructions that, when executed by the one or more processors, cause the one or more processors to perform the functions described with regard to server 608. Generally, server 608 is configured to receive and store data regarding gaming machines 602-604 and to provide the data to a user interface (e.g., a display, a handheld device, etc.). In some cases, server 608 may perform data analysis on the received data. For example, server 608 may determine averages, trends, metrics, etc., for one or more of gaming machines 602-604. Data may be sent by gaming machines 602-604 to server 608 in real-time (e.g., whenever a change in credits or cash occurs, whenever another type of system event occurs, etc.), periodically (e.g., every fifteen minutes, every hour, etc.), or in response to a request from server 608.

The data received by server 608 from gaming machines 602-604 via network 606 may include accounting data. Accounting data may be, but is not limited to, data indicative of cash or credits received by gaming machines 602-604 and cash or credits paid out by gaming machines 602-604. The accounting data may also include data regarding the amount of money added or removed from gaming machines 602-604 by the operator of the establishment. For example, a casino worker may periodically collect money from gaming machines 602-604 and/or restock the supply of coins in gaming machines 602-604. Server 608 may process the collected accounting data and generate one or more reports regarding the financial state of gaming machines 602-604 (e.g., that a collection should be made from a machine, that additional coins should be added to a machine, the amount of money a machine has generated, etc.).

In some embodiments, the data received by server 608 may include data related to a user's loyalty account. For example, a user of gaming machine 602 may link their loyalty account to gaming machine 602, so that she can gain loyalty points, free turns, etc., while playing gaming machine 602. A user may link his or her loyalty account to gaming machine 602 in any number of ways. For example, the user may insert a loyalty card into gaming machine 602 and/or provide biometric data to gaming machine 602 (e.g., by conducting a finger print scan, a retinal scan, etc.). In some cases, a mobile device operated by the user may provide data regarding the user's loyalty account to gaming machine 602. The mobile device may transfer data to gaming machine 602 wirelessly (e.g., via Bluetooth, WiFi, etc.), via a wired connection (e.g., via a USB cable, a docking station, etc.), or even via the user's body (i.e., the mobile device transmits data through the user's body and into gaming machine 602). Server 608 may then associate the user's time playing gaming machine 602 with the user's loyalty account (e.g., to add loyalty points to the user's account, to provide certain rewards to the user, such as a bonus turn, etc.).

Server 608 may provide data to gaming machines 602-604 via network 606. For example, server 608 may provide service windows to gaming machines 602-604. The service window may be a generic service window or a service window based in part on the loyalty account associated with the gaming machine. For example, the service window may appear within a Flash application executed by gaming machines 602-604. In one embodiment, such a service window may be a stand-alone application executed by one of gaming machines 602-604. A service window may be configured to provide notifications to players and to allow players to perform various actions, such as redeeming loyalty points, making hotel reservations, etc. In some embodiments, the service window may include an option to request a game for download to one of gaming machines 602-604.

According to various embodiments, server 608 may provide a game for download to one of gaming machines 602-604, in response to receiving a request for the game. For example, a player at gaming machine 602 may request a certain slot-related game. In response, server 608 may provide the requested game to gaming machine 602 via network 606. In some embodiments, the receiving gaming machine may validate the downloaded game prior to allowing a player to play the game.

A game downloaded to one of gaming machines 602-604 may be removed from memory under a number of conditions. In some cases, a downloaded game may be removed from memory after the requesting player finishes playing the game or the player's account is no longer associated with the gaming machine. In other cases, a downloaded game may remain in memory and be available to other players indefinitely or for a certain period of time. For example, a game may be available to players of the gaming machine for one day after download. A game also may be removed from memory based on how long it has been since the game was last played on the gaming machine. For example, a game that has not been played for two weeks may be removed from memory to make room for another game.

Figure 7:
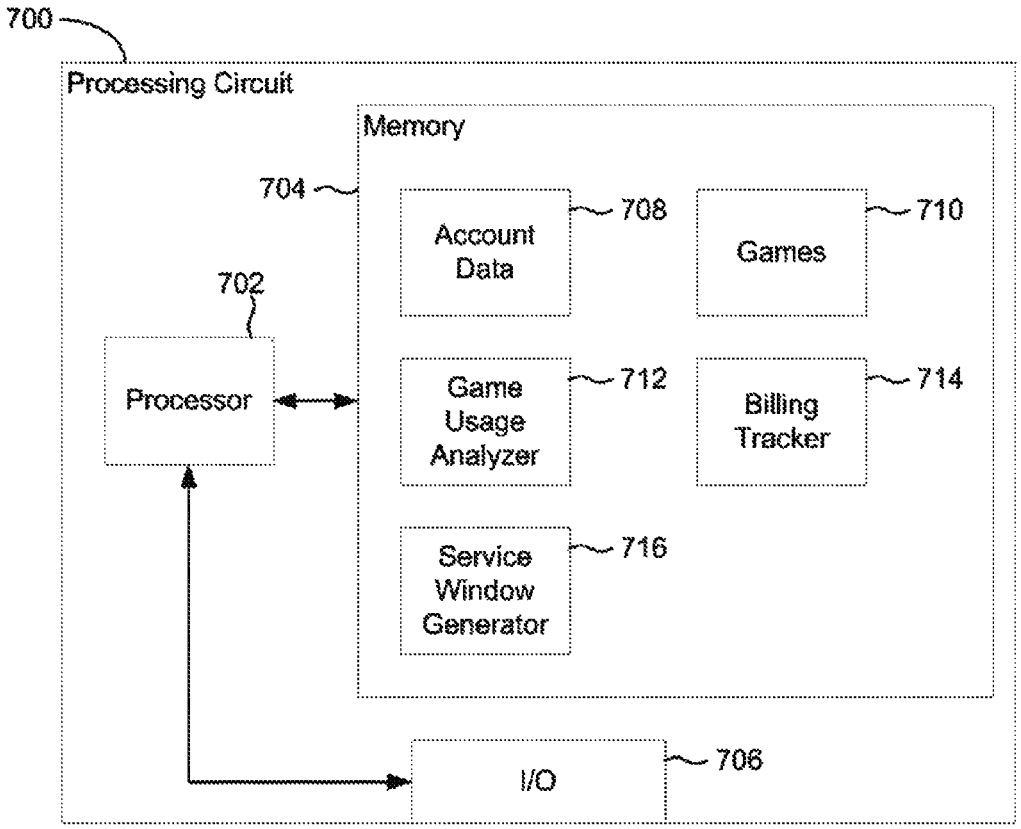
FIG. 7 a block diagram of a processing circuit configured to provide a game to a gaming machine, according to some embodiments.

Referring now to FIG. 7, a block diagram of a processing circuit 700 configured to provide a game to a gaming machine is shown, according to various embodiments. Processing circuit 700 may be a component of a server or may be formed by a plurality of computing devices in communication with one another. For example, processing circuit 700 may include processors, memories, hardware, and software from multiple computing devices within a data center.

Processing circuit 700 may include a processor 702 and a memory 704. Memory 704 stores machine instructions that, when executed by processor 702, cause processor 702 to perform one or more operations described herein. Processor 702 may include a microprocessor, FPGA, ASIC, any other form of processing electronics, or combinations thereof. Memory 704 may be any electronic storage medium such as, but not limited to, a floppy disk, a hard drive, a CD-ROM, a DVD-ROM, a magnetic disk, RAM, ROM, EEPROM, EPROM, flash memory, optical memory, or combinations thereof. Memory 704 may be a tangible storage medium that stores non-transitory machine instructions. Processing circuit 700 may include any number of processors and memories. In other words, processor 702 may represent the collective processing devices of processing circuit 700 and memory 704 may represent the collective storage devices of processing circuit 700. Processor 702 and memory 704 may be on the same printed circuit board or may be in communication with each other via a bus or other form of connection.

I/O hardware 706 includes the interface hardware used by processing circuit 700 to receive data from other devices and/or to provide data to other devices. For example, a command may be sent from processing circuit 700 to a gaming machine via I/O hardware 706. I/O hardware 706 may include, but is not limited to, hardware to communicate on a local system bus and/or on a network. For example, I/O hardware 706 may include a port to transmit display data to an electronic display and another port to receive data from a network.

Memory 704 may store loyalty account data 708. In general, a loyalty account creates an incentive for a player to play games via rewards and services. For example, loyalty account data 708 may include account data that identifies the player (e.g., the player's name, contact information, etc.) and a number of loyalty points earned by the player through game play. Loyalty account data 708 may also include data regarding a player's favorite drink, the number of bonus credits earned by a player, and the circumstances regarding the player's use of a game. For example, account data 708 may include data indicative of which games were played by the player, how long the games were played, when the games were played, how much the player wagered in the games, and other such data.

Memory 704 may store one or more games 710. Games 710 may include games configured for execution by a gaming machine. For example, one of games 710 may be a slot-based game configured for execution by a video slot machine. Games 710 may include thick and/or thin client games. Generally, a thick client game include the complete logic for the game, include the game's outcome determining logic. A thin client game, however, may be executed on one device and generated display data provided to another device running a thin client. For example, a thin client game in games 710 may be executed by processor 702 and display data for the game provided to a remote gaming machine via I/O hardware 706. Games 710 may include wager-based games and/or games that do not involve the actual wagering of money. Games 710 may also include games executable as applications on portable devices (e.g., cell phones, tablet computers, etc.) and online games playable via a web browser.

Memory 704 may store a service window generator 716 configured to provide a service window to a gaming machine or other remote device via I/O hardware 706. Generally, a service window refers to any graphical interface that provides information regarding a player's loyalty account, provides entertainment-related services to a player, and/or allows messages to be sent to a player. Typically, a service window may be displayed in conjunction with a running game (e.g., at the same time), but may also be displayed separately (e.g., when no game is running).

The service window generated by service window generator 716 may be associated with account data 708. For example, service window generator 716 may provide a service window to a gaming machine, in response to processing circuit 700 receiving data identifying a player's loyalty account in account data 708. The service window may include data regarding the number of earned loyalty points in the player's loyalty account and other such account data. In other embodiments, the service window may be a generic service window that is not associated with a particular loyalty account.

According to various embodiments, the service window generated by service window generator 716 may include an option to download and play one of games 710. For example, the service window may include availability information regarding a slot-based game in games 710. If the slot-based game is available and a request for the game is received by processing circuit 700, the game may be returned via I/O hardware 706. Which of games 710 are available via the service window may be based in part on the player's loyalty account, the games' license terms, the location of the receiving device, and other such factors. The service window may also include suggested games that have already been downloaded to the device or are available for download.

Memory 704 may include game usage analyzer 712 configured to monitor players' use of games 710. For example, a remote gaming machine may provide data to game usage analyzer 712 indicative of when a game was played, the wagers made within the game, and the outcomes of the game. If a player has registered his or her loyalty account with the gaming machine, game usage analyzer 712 may credit loyalty points, bonus credits, or other incentives to the player's account in account data 708. For example, a player may earn 1,000 loyalty points for every ten hands of blackjack played in a game. In some embodiments, game usage analyzer 712 may analyze a player's use of games 710 to determine a player's interests. Such interests may be provided as suggestions within the service window generated by service window generator 716.

Memory 704 may include a billing tracker 714. In various embodiments, billing tracker 714 may receive game usage data from game usage analyzer 712 and/or game download data from service window generator 716. Billing tracker 714 may use the game usage data and/or game download data to generate an invoice for an operator of a gaming environment. For example, a casino may be charged for a game based on the game being downloaded to one of the casino's gaming machines. In another example, the casino may be charged based on the amount of play time the game received in the casino. In some cases, a gaming environment may be granted a limited license to use one games 710. For example, a game may be played for a certain amount of time for free before a casino operator is charged for its use.

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on one or more computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing apparatus on data stored on one or more computer-readable storage devices or received from other sources.

The term "client or "server" include all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

The invention is claimed as follows:

1. A gaming system comprising:

a housing;

at least one display device supported by the housing;

a plurality of input devices supported by the housing, said plurality of input devices including:

(i)an acceptor, and (ii) a cashout device;

at least one processor; and at least one memory device which stores a plurality of instructions, which when executed by the at least one processor, cause the at least one processor to operate with the at least one display device and the plurality of input devices to:

(a) if a physical item is received via the acceptor, establish a credit balance based, at least in part, on a monetary value associated with the received physical item, (b) display to a player a game available to be downloaded, said displayed game being:

(i) determined based, at least in part, on at least one online game previously played, over a data network, by the player, and (ii) displayed in a service window of the at least one display device, said service window being distinct from a game play window available to be concurrently displayed by the at least one display device, (c) if the game is downloaded and a wager is placed on a play of the game:

(i) randomly determine a game outcome, (ii) display the randomly determined game outcome in the game play window, (iii) determine any award associated with the randomly determined game outcome, and (iv) display any determined award associated with the randomly determined game outcome, and (d) if a cashout input is received via the cashout device, cause an initiation of any payout associated with the credit balance.

2. The gaming system of claim 1, wherein when executed by the at least one processor, the plurality of instructions cause the at least one processor to operate with the at least one display device to display to the player a plurality of games available to be downloaded, said plurality of displayed games being displayed in the service window of the at least one display device.

3. The gaming system of claim 2, wherein the plurality of games available to be downloaded are each determined, at least in part, on the at least one online game previously played, over the data network, by the player.

4. The gaming system of claim 1, wherein the game available to be downloaded is determined, at least in part, on a plurality of online games previously played, over the data network, by the player.

5. The gaming system of claim 1, wherein the at least one online game includes an online wagering game.

6. The gaming system of claim 1, wherein the service window is associated with a remote server.

7. The gaming system of claim 1, wherein at least one of any wager placed on the play of the game and any determined award are selected from the group consisting of: a quantity of monetary credits, a quantity of non-monetary credits, a quantity of promotional credits, and a quantity of player tracking points.

8. A gaming system server comprising:

at least one processor; and at least one memory device which stores a plurality of instructions, which when executed by the at least one processor, cause the at least one processor to:

(a) cause at least one display device to display to a player a game available to be downloaded, said displayed game being:

(i) determined based, at least in part, on at least one online game previously played, over a data network, by the player, and (ii) displayed in a service window of the at least one display device, said service window being distinct from a game play window available to be concurrently displayed by the at least one display device, and (b) if the game is downloaded and a wager is placed on a play of the game:

(i) randomly determine a game outcome, (ii) display the randomly determined game outcome in the game play window, (iii) determine any award associated with the randomly determined game outcome, and (iv) display any determined award associated with the randomly determined game outcome, wherein a credit balance is increasable based on the determined award amount associated with the randomly determined game outcome, said credit balance being increasable via an acceptor of a physical item associated with a monetary value, and decreasable via a cashout device.

9. The gaming system server of claim 8, wherein when executed by the at least one processor, the plurality of instructions cause the at least one processor to cause the at least one display device to display to the player a plurality of games available to be downloaded, said plurality of displayed games being displayed in the service window of the at least one display device.

10. The gaming system server of claim 9, wherein the plurality of games available to be downloaded are each determined, at least in part, on the at least one online game previously played, over the data network, by the player.

11. The gaming system server of claim 8, wherein the game available to be downloaded is determined, at least in part, on a plurality of online games previously played, over the data network, by the player.

12. The gaming system server of claim 8, wherein the at least one online game includes an online wagering game.

13. The gaming system server of claim 8, wherein at least one of any wager placed on the play of the game and any determined award are selected from the group consisting of: a quantity of monetary credits, a quantity of non-monetary credits, a quantity of promotional credits, and a quantity of player tracking points.

14. A method of operating a gaming system, said method comprising:

(a) causing at least one display device to display to a player a game available to be downloaded, said displayed game being:

(i) determined based, at least in part, on at least one online game previously played, over a first data network, by the player, and (ii) displayed in a service window of the at least one display device, said service window being distinct from a game play window available to be concurrently displayed by the at least one display device, and (b) if the game is downloaded and a wager is placed on a play of the game:

(i) causing at least one processor to execute a plurality of instructions to randomly determine a game outcome, (ii) causing the at least one display device to display the randomly determined game outcome in the game play window, (iii) causing the at least one processor to execute the plurality of instructions to determine any award associated with the randomly determined game outcome, and (iv) causing the at least one display device to display any determined award associated with the randomly determined game outcome, wherein a credit balance is increasable based on the determined award amount associated with the randomly determined game outcome, said credit balance being increasable via an acceptor of a physical item associated with a monetary value, and decreasable via a cashout device.

15. The method of claim 14, wherein when executed by the at least one processor, the plurality of instructions cause the at least one processor to cause the at least one display device to display to the player a plurality of games available to be downloaded, said plurality of displayed games being displayed in the service window of the at least one display device.

16. The method of claim 15, wherein the plurality of games available to be downloaded are each determined, at least in part, on the at least one online game previously played, over the data network, by the player.

17. The method of claim 14, wherein the game available to be downloaded is determined, at least in part, on a plurality of online games previously played, over the data network, by the player.

18. The method of claim 14, wherein the at least one online game includes an online wagering game.

19. The method of claim 14, wherein the service window is associated with a remote server.

20. The method of claim 14, wherein at least one of any wager placed on the play of the game and any determined award are selected from the group consisting of: a quantity of monetary credits, a quantity of non-monetary credits, a quantity of promotional credits, and a quantity of player tracking points.

21. The method of claim 14, which is provided through a second data network.

22. The method of claim 21, wherein the second data network is an internet.

* * * * *